US005391240A

United States Patent [19]

Seidel et al.

[11] Patent Number: 5,391,240

[45] Date of Patent: Feb. 21, 1995

[54] PROCESS FOR THE PASSIVATING POST-TREATMENT OF PHOSPHATIZED METAL SURFACES

[75] Inventors: Reinhard Seidel, Monheim; Karl-Dieter Brands, Duesseldorf; Karl-Heinz Gottwald, Erftstadt, all of Germany

[73] Assignee: Henkel Kommanditgesellschaft auf Aktien, Duesseldorf, Germany

[21] Appl. No.: 39,106

[22] PCT Filed: Sep. 30, 1991

[86] PCT No.: PCT/EP91/01870

§ 371 Date: Apr. 8, 1993

§ 102(e) Date: Apr. 8, 1993

[87] PCT Pub. No.: WO92/06226

PCT Pub. Date: Apr. 16, 1992

[30] Foreign Application Priority Data

Oct. 8, 1990 [DE] Germany ..... 4031817

[51] Int. Cl.[6] ..... C23C 22/82

[52] U.S. Cl. ..... 148/256; 148/255; 148/247

[58] Field of Search ..... 148/256, 257, 255, 247

[56] References Cited

U.S. PATENT DOCUMENTS 3,615,895 10/1971 Freyhold ..... 148/256
4,462,842 7/1984 Uchiyama et al. ..... 148/6.15

FOREIGN PATENT DOCUMENTS 0085626 8/1983 European Pat. Off. .
0149720 7/1985 European Pat. Off. .
1277646 9/1968 Germany .
1945216 3/1970 Germany .
1621467 2/1977 Germany .
2701321 8/1977 Germany .

OTHER PUBLICATIONS

*Chemical Abstracts,* 101:96199z (JP-A-84/59 885), 1984.

*Chemical Abstracts,* 87:205007a (JP-A-77/068 830) 1977.

*Primary Examiner*—Sam Silverberg

*Attorney, Agent, or Firm*—Ernest G. Szoke; Wayne C. Jaeschke; Norvell E. Wisdom, Jr.

[57] ABSTRACT

The invention concerns a process for a passivating post-treatment of phosphated metal surfaces of iron, steel, galvanized steel, zinc, aluminum, and their alloys, in which the phosphated metal surfaces are brought into contact at temperatures in the range from 10° to 60° C. with chromium-free, acidic, silicate-containing aqueous solutions having a pH in the range of 2 to 5 and 0.5 to 50 g/l of $SiO_2$ and 0.5 to 100 g/l of an acid.

20 Claims, No Drawings

PROCESS FOR THE PASSIVATING POST-TREATMENT OF PHOSPHATIZED METAL SURFACES

FIELD OF THE INVENTION

This invention relates to a process for the passivating post-treatment of phosphated metal surfaces of iron, steel, galvanized steel, zinc, aluminum and alloys thereof with chromium-free, silicate-containing aqueous solutions.

STATEMENT OF RELATED ART

The protection of surfaces of the above-mentioned metals by phosphate coatings has long been known (*Ullmanns Encyklopadie der technischen Chemie* [Title in English: Ullmann's Encyclopedia of Technical Chemistry], 4th Edition, Vol. 15 (1978), pages 686–688). The surfaces mentioned are phosphated to increase the adhesive strength of lacquer films and to improve corrosion resistance. More particularly, the phosphate coatings are intended to prevent rusting of the metal surface to which the lacquers are applied.

For some considerable time, after-rinsing with chromium(VI)-containing solutions has been used to improve the effect of the phosphate coatings. These solutions passivate the metal surface still exposed in the pores of the phosphate layer. In addition, the solubility of the phosphate crystals forming the phosphate coating is greatly reduced by ion exchange reactions.

However, the advantages of the improved phosphate coating are offset by major disadvantages of the standard chromium(VI) process. The most serious of these is the high toxicity of chromium(VI).

Accordingly, various proposals for the passivating post-treatment of phosphated metal surfaces with chromium-free solutions can already be found in the literature:

Thus, chromium-free compositions and a process for the treatment of phosphated metal surfaces are known from EP-A-0 085 626. In this case, the phosphate coatings mentioned are after-passivated by application of titanium(III)-solutions at pH values of 2 to 7. On account of the extreme instability of the titanium(III) ion, the compositions are preferably prepared immediately before use or are stabilized by the presence of relatively large quantities of organic compounds.

DE-A-27 01 321 describes a process for the post-treatment of phosphated surfaces of zinc or zinc alloys in which the surfaces are treated with a chromium-free aqueous solution containing titanium ions and, in addition, one or more components from the group consisting of phosphoric acid, phytic acid, tannin and hydrogen peroxide. In this case, too, a pH value of 2 to 6 is largely maintained. However, this process is confined solely to galvanized steel surfaces.

In addition, EP-A-149 720 describes a process for the after-passivation of phosphated metal surfaces using chromium-free aqueous solutions containing titanium-(IV), manganese(II), cobalt(II), nickel(II) and/or copper(II) ions. In this process, the phosphated surfaces of iron, steel, galvanized steel or aluminum are first rinsed with water, then treated at 20° to 120° C. with acidic to neutral aqueous solutions containing the cations mentioned above, subsequently re-rinsed with water and optionally dried. However, even this process does not provide entirely satisfactory results from the applicational point of view.

DE-B-12 77 646 describes a process for increasing the corrosion resistance of surfaces of aluminum and aluminum alloys by application of coating using green chromating solutions containing hexavalent chromium, phosphate and fluoride and post-treatment of the coating with aqueous solutions having a pH value of 9 to 13. Sodium silicates (orthosilicates and condensed silicates), for example, may be used for the preparation of these alkaline-reacting post-treatment solutions. The advantages sought by this process cannot be obtained with solutions having a pH value below 9.

A process for the post-treatment of protective oxide coatings or other conversion coatings on metal surfaces with alkali metal silicate solutions is also known from DE-C-16 21 467. In this case, the disadvantages of known processes, namely post-treatment of phosphate coatings with sodium silicate solutions, attributable to the high alkalinity are overcome by aftertreating the coatings applied with solutions of lithium silicate in which the molar ratio of $SiO_2$ to $Li_2O$ is from 3.1 to 3.5:1. This process is carried out at temperatures of 70° to 100° C.

However, the chromium-free processes mentioned above have not been successful in practice. Accordingly, phosphate coatings as an adherent surface for cathodic electrodeposition are still mainly aftertreated with products based on chromium salts by virtue of their good quality profile (W. Rausch: *Die Phosphatierung yon Metallen* [Title in English: *The Phosphating of Metals*] (E. Leuze Verlag, Sauleau, 1988), p. 159. It is also known that metal surfaces can be directly treated with silicate-containing solutions to improve corrosion prevention. In this case, it is not a phosphate coating, but the metal surface itself which is treated.

*Chemical Abstracts,* 109:26076y (JP-A-88/50 484), describes the treatment of galvanized or aluminum-coated steel plates with silicate sols additionally containing titanium, zirconium, magnesium, barium, strontium, tungsten, nickel, cobalt, vanadium, calcium, molybdenum, copper, aluminum, tin, beryllium and/or manganese. Corresponding silicate-containing protective coatings are formed.

DE-A-29 43 833 describes the formation of chromium-free conversion coatings on galvanized steel plates using aqueous solutions which, in addition to sulfuric acid and hydrogen peroxide, also contain alkali metal silicates and optionally organophosphorus compounds.

*Chemical Abstracts,* 101:96199z (JP-A-84/59 885), also describes the use of silicate-containing solutions for the formation of corrosion-resistant coatings on metal surfaces. The solutions used for this purpose are obtained by dissolving titanium sulfate in sodium silicate solutions and have a pH value of $\leqq 2$. The metal surfaces may optionally be treated before or after this treatment with sodium silicate solutions which have a pH value $\geqq 10$ and which in addition contain alum, potassium carbonate and/or potassium iodide.

In addition, the surface treatment of zinc or galvanized metals with solutions containing alkali metal or alkaline earth metal hydroxides in addition to silica is known from *Chemical Abstracts,* 87:205007a (JP-A-77/068 830). The coating obtained is again intended to prevent corrosion.

EP-A-273 698 describes a process for the formation of coatings on metal surfaces using aqueous dispersions containing on the one hand acidic trivalent metal compounds, particularly those of aluminum, iron or chromium, and on the other hand fine-particle silicic acid. Dispersions such as these may also be used together with acidic phosphating solutions based on zinc, manganese or iron(II) ions and phosphoric acid. Conversion layers which may be used as a base for subsequent lacquering are obtained.

DESCRIPTION OF THE INVENTION

Object of the Invention

By contrast, the problem addressed by the present invention was to develop a process for the passivating post-treatment of phosphated metal surfaces which would be based on chromium-free post-treatment solutions and which would represent an equally effective replacement for the hitherto usual after-passivation of phosphate coatings with chromium(VI)-containing solutions.

Summary of the Invention

Accordingly, the present invention relates to a process for the passivating post-treatment of phosphated metal surfaces of iron, steel, galvanized steel, zinc, aluminum and alloys thereof with chromium-free, silicate-containing aqueous solutions, characterized in that the phosphated metal surfaces are contacted at temperatures of 10° to 60° C. with acidic, silicate-containing aqueous solutions which have a pH value of 2 to 5 and which contain from 0.5 to 50 g/l $SiO_2$ and 0.5 to 100 g/l of an acid.

It has surprisingly been found that the chromium-free after-passivation process according to the invention is equivalent to known processes based on chromium-containing solutions. Where reference is made in connection with the present invention to "chromium-free" after-passivation processes or solutions, this means that the solutions to be used in accordance with the invention do not contain any additions of chromium-containing compounds. This does not include possible contamination of the solutions to be used in accordance with the invention with chromium-containing compounds which may emanate from the chemicals used to prepare these solutions. In that case, however, the chromium content of the solutions should be at most 100 ppm and, in particular at most 10 ppm.

DESCRIPTION OF PREFERRED EMBODIMENTS

Particular significance is attributed to the $SiO_2$ concentration of the aqueous solutions to be used in the process according to the invention. Generally, these solutions should have a content of silicates or silica sols which is equivalent to a stoichiometric quantity of 0.5 to 50 g/l $SiO_2$. $SiO_2$ concentrations in the range from 0.5 to 10 g/l and, more particularly, in the range from 1 to 6 g/l are preferred. In the context of the process according to the invention, the expression "silicate-containing aqueous solutions" is also intended to encompass corresponding colloidal solutions. For example, commercially available aqueous alkali metal silicate solutions—also known as "waterglass solutions"—may serve as a source for the silicate-containing solutions to be used in accordance with the invention. Waterglass solutions of the type in question may contain sodium, potassium or even lithium as alkali metals. Aqueous sodium silicate solutions—also known as "soda waterglass solutions"—are particularly preferred for the purposes of the present invention. In addition, low-alkali silica sols, which are also commercially available, may be used as the silicate source. Another silicate source for the silicate-containing aqueous solutions to be used in accordance with the invention are powder-form alkali metal silicates, sodium silicates again being preferred.

The pH value and acid concentration of the silicate-containing aqueous solutions to be used in accordance with the invention are also of crucial significance in the process according to the invention. The pH value of these solutions should generally be in the range from 2 to 5 although, according to the invention, a pH value of 2.5 to 5 is preferred for the solutions to be used. The pH value of the solutions is adjusted with an acid. The acid concentration of the aqueous solutions should generally be in the range from 0.5 to 100 g/l. Aqueous solutions containing 1 to 25 g/l acid are preferably used in the process according to the invention. The acid concentration in the ranges mentioned is governed in particular by the desired pH value in the after-passivation solutions. Suitable acids for the process according to the invention are, generally, any organic and/or inorganic acids which do not adversely affect the phosphate coatings on the metal surfaces or which could have corrosive effects. Accordingly, acetic acid, oxalic acid, citric acid and phosphoric acid, for example, may be used as acids in the process according to the invention, oxalic acid, citric acid and phosphoric acid being particularly preferred. Phosphoric acid and citric acid are particularly suitable for use in the process according to the invention. The object of this acid addition is not solely to adjust the pH value of the aqueous solutions to be used in accordance with the invention, but also to stabilize the solutions. In addition, considerable importance is attributed to the acids, particularly phosphoric acid and citric acid, with regard to the passivating post-treatment of the phosphate coatings.

In the process according to the invention, the phosphated metal surfaces are treated with the acidic silicate-containing aqueous solutions at temperatures in the range from 10° to 60° C. A temperature in the range from 15° to 40° C. and more particularly in the range from 20° to 25° C., i.e. room temperature, is preferred for the process according to the invention.

In this connection, the time for which the process according to the invention is carried out is also worth mentioning. The phosphated metal surfaces are preferably contacted with the acidic silicate-containing aqueous solutions for 5 to 120 seconds and, more particularly, for 10 to 40 seconds. Longer contact times do not afford any advantages and can even give rise to disadvantages because excessively long contact times can cause separation of the phosphate coatings by the acidic in-use solutions.

In one preferred embodiment of the present invention, the acidic silicate-containing aqueous solutions may contain 0.5 to 5 g/l titanium(IV) ions. A concentration of titanium(IV) ions of 1 to 3 g/l is preferred. Virtually any water-soluble titanium(IV) salts may be used as a source for the titanium(IV) ions. Potassium hexafluorotitanate ($K_2TiF_6$) and/or potassium titanyl oxalate ($K_2TiO(C_2O_4)_2$) are preferred for the purposes of the invention.

The presence of titanium(IV) ions on the one hand increases the stability of the acidic, silicate-containing aqueous in-use solutions and, in addition, improves the corrosion resistance of the phosphated metal surfaces to be obtained by the passivating post-treatment.

The process according to the invention may be carried out in the usual way known from the prior art, i.e. the phosphated metal surfaces are contacted with the acidic silicate-containing aqueous solutions by spraying, dipping, flooding or combinations thereof. However, the solutions are preferably applied by spraying or dipping. Rinsing of the phosphated metal surfaces with water before the passivating post-treatment is generally not necessary. However, if preliminary rinsing appears desirable in certain cases, it should be carried out with deionized or fully salt-free water to prevent unwanted ions from being carried over into the after-passivation solutions.

The process according to the invention for the passivating post-treatment of phosphated metal surfaces is suitable for all phosphate coatings known from the prior art which are obtained both by the so-called "non-layer-forming phosphating processes" and by the so-called "layer-forming phosphating processes". The process according to the invention is particularly suitable for the passivating post-treatment of phosphate coatings obtained by the so-called "low zinc" phosphating process. A detailed explanation of these phosphating processes can be found in W. Rausch's above-cited standard work entitled *Die Phosphatierung yon Metallen.*

The metal surfaces passivated and phosphated by the process according to the invention are eminently suitable for subsequent coating with paints, lacquers, varnishes and the like. The now standard powder lacquers and coil coating lacquers are mentioned by way of example in this regard. However, the process according to the invention is particularly suitable for the passivating post-treatment of phosphate coatings, more particularly those obtained by the "low zinc" phosphating process, which are subsequently subjected to cathodic electrodeposition. In this case, the phosphate coatings are rinsed with water after the passivating post-treatment, for which purpose deionized water or fully salt-free water should again be used. Generally, however, there is no need for after-rinsing with water unless it appears desirable in special cases.

The acidic silicate-containing aqueous solutions to be used in accordance with the invention are preferably prepared from aqueous alkali metal silicate solutions (waterglass solutions) which have an $SiO_2$ content in the desired range mentioned above. As already mentioned, sodium silicate solutions (soda waterglass solutions) are particularly suitable for this purpose. The waterglass solutions are introduced with vigorous stirring into an aqueous solution of the selected acid; the acid concentration should again be in the range mentioned above. The titanium(IV) component is then optionally added. Unless the pH value is to be in the range mentioned above, it may be adjusted by addition of aqueous alkali metal hydroxide solutions, more particularly sodium hydroxide solutions. Generally, however, it is also possible initially to prepare silicate-containing aqueous concentrates of the post-treatment solutions which may generally contain 100 to 500 g/l $SiO_2$. To this end, waterglass solutions are mixed with aqueous solutions of the selected acid with vigorous stirring in the manner described above. To avoid gelation, the pH in the concentrates should not exceed a value of 2. For application, the concentrates are subsequently diluted with deionized or fully salt-free water, the pH is optionally adjusted to the value mentioned above and, if desired, the titanium(IV) component is added.

EXAMPLES

After-passivation solutions to be used in accordance with the invention were prepared by introduction of an $SiO_2$-containing solution into the aqueous acid with vigorous stirring. In Examples 1 and 2, a commercially available silica sol containing approximately 40% by weight $SiO_2$ (LUDOX® HS40, a product of DuPont, USA) was used as the $SiO_2$-containing solution; in all the other Examples, a commercially available aqueous soda waterglass (soda waterglass HK30, a product of Henkel KGaA; 22.3% $SiO_2$, 5.8% Na2O, solids content 28.1%, molar ratio of $SiO_2$ to $Na_2O$=3.97:1) was used. The acids used were oxalic acid (Examples 1, 4 and 9), citric acid (Examples 10 and 11 ) and phosphoric acid (all other Examples). A titanium (IV) salt was then added in the case of Examples 2, 4, 5, 6, 10 and 11 and the pH value of the resulting aqueous solutions was adjusted with aqueous sodium hydroxide solution. The composition of the solutions obtained for Examples 1 to 11 is shown in Table 1 below.

These solutions were used for the after-passivation of phosphated metal surfaces as described in the following. The temperatures applied are also shown in Table 1.

Cold-rolled steel plates (CRS) and steel plates electrolytically galvanized on both sides (ZE) (100×200 $mm^2$) were treated as follows:

(a) chemical cleaning and degreasing using a mild alkaline spray cleaner (RIDOLINE® C1250E, a product of Henkel KGaA, concentration 2% by weight) for 3 minutes at about 60° C.;

TABLE 1

SOLUTIONS AND CONDITIONS USED IN ACCORDANCE WITH THE INVENTION

| Example | $SiO_2$, g/l | $H_3PO_4$, g/l | Oxalic Acid, g/l | Citric Acid, g/l | $K_2TiF_6$, g/l | $K_2TiO(C_2O_4)_2.2H_2O$, g/l | pH Value | Temp., °C. |
|---|---|---|---|---|---|---|---|---|
| 1 | 8.0 | — | 5 | — | — | — | 3.9 | 40 |
| 2 | 6.0 | 5 | — | — | — | 22 | 3.5 | 20 |
| 3 | 8.8 | 16 | — | — | — | — | 2.5 | 40 |
| 4 | 4.4 | — | 6 | — | — | 9 | 2.7 | 20 |
| 5 | 4.4 | 13 | — | — | 6 | — | 2.8 | 20 |
| 6 | 2.2 | 7 | — | — | 6 | — | 2.8 | 20 |
| 7 | 5.0 | 6 | — | — | — | — | 2.8 | 20 |
| 8 | 5.0 | 10 | — | — | — | — | 2.8 | 20 |
| 9 | 5.0 | — | 6 | — | — | — | 3.1 | 20 |
| 10 | 2.2 | — | — | 2 | 5 | — | 4,5 | 20 |
| 11 | 4.4 | — | — | 3 | 5 | — | 4.5 | 20 |

(b) rinsing with fully salt-free water at room temperature for 30 seconds;

(c) activation with titanium phosphates (FIXODINE® 6, a product of Henkel KGaA; concentration 0.2% by weight; room temperature; treatment 2 mins. immersion);

(d) phosphating with a commercially available phosphating agent (nitrate/nitrite-accelerated phosphating agent GRANODINE® 952 containing zinc, nickel and manganese, a product of Henkel KGaA, with a free acid content of 1.0 and a total acid content of 15 points) for 1 minute at a temperature of 50° C.;

(e) rinsing with fully salt-free water for 30 seconds;

(f) after-passivation as described above for 30 seconds;

(g) rinsing with fully salt-free water for 30 seconds and (h) drying for 10 minutes at an object temperature of 80° C.

For comparison, a commercially available chromium-containing after-passivating agent (DEOXYLYTE® 41, a product of Henkel KGaA) was used in a quantity of 0.14% by weight at 40° C. in step (f).

After drying, the plates were coated with an epoxy-based cathodic electrodeposition lacquer (AQUALUX® K, a product of IDAC). The dry film thickness was 21±2 μm. The plates were then provided with a single cut in accordance with DIN 53 167 and subjected for 8 weeks to the alternating climate test according to VDA 621-415. Table 2 below shows the evaluation according to DIN 53 167.

The values shown for the creepage beneath the lacquer film are average values (from three plates) which were measured on one side of the particular single cut.

TABLE 2

| | Corrosion test | |
|---|---|---|
| | Creepage [mm] | |
| Example | CRS[1)] | ZE[2)] |
| 1 | 2.0 | 2.9 |
| 2 | 1.8 | 2.3 |
| 3 | 1.5 | 2.6 |
| 4 | 1.3 | 1.8 |
| 5 | 0.9 | 1.3 |
| 6 | 1.0 | 1.5 |
| 7 | 1.2 | 1.7 |
| 8 | 0.8 | 1.3 |
| 9 | 1.4 | 2.0 |
| 10 | 1.4 | 1.8 |
| 11 | 1.0 | 1.5 |
| Comparison | 1.2 | 1.7 |

[1)] = Cold-rolled steel plates
[b)] = Electrolytically galvanized steel plates

The above results show that the chromium-free after-passivation process according to the invention is entirely equivalent to the chromium-containing process.

The invention claimed is:

1. A process for the passivating post-treatment of phosphated metal surfaces of iron, steel, galvanized steel, zinc, aluminum and alloys thereof with chromium-free silicate-containing aqueous solutions, wherein the phosphated metal surfaces are contacted at temperatures of 10° to 60° C. with acidic, silicate-containing aqueous solutions which have a pH value of 2 to 5 and which contain 0.5 to 50 g/l of $SiO_2$ and 0.5 to 100 g/l of an acid.

2. A process as claimed in claim 1, wherein the acidic, silicate-containing aqueous solutions are sodium silicate solutions containing phosphoric acid, oxalic acid, citric acid, or mixtures thereof.

3. A process as claimed in claim 2, wherein the acidic, silicate-containing aqueous solutions contain 1 to 6 g/l of $SiO_2$.

4. A process as claimed in claim 2, wherein the acidic, silicate-containing aqueous solutions contain 1 to 25 g/l of acid.

5. A process as claimed in claim 4, wherein the acidic, silicate-containing aqueous solutions have a pH value of 2.5 to 5.

6. A process as claimed in claim 5, wherein the acidic, silicate-containing aqueous solutions contain 1 to 3 g/l of titanium(IV) ions.

7. A process as claimed in claim 6, wherein the titanium(IV) ions are from $K_2TiF_6$, $K_2TiO(C_2O_4)_2$, or both.

8. A process as claimed in claim 7, wherein the phosphated metal surfaces are contacted with the acidic, silicate-containing aqueous solutions at temperatures of 20° to 25° C.

9. A process as claimed in claim 8, wherein the phosphated metal surfaces are contacted with the acidic, silicate-containing aqueous solutions for 10 to 40 seconds.

10. A process as claimed in claim 1, wherein the acidic, silicate-containing aqueous solutions contain 0.5 to 10 g/l of $SiO_2$.

11. A process as claimed in claim 1, wherein the acidic, silicate-containing aqueous solutions contain 1 to 25 g/l of acid.

12. A process as claimed in claim 1, wherein the acidic, silicate-containing aqueous solutions have a pH value of 2.5 to 5.

13. A process as claimed in claim 3, wherein the acidic, silicate-containing aqueous solutions contain 1 to 3 g/l of titanium(IV) ions.

14. A process as claimed in claim 13, wherein the titanium(IV) ions are from $K_2TiF_6$, $K_2TiO(C_2O_4)_2$, or both.

15. A process as claimed in claim 1, wherein the acidic, silicate-containing aqueous solutions contain 0.5 to 5 g/l of titanium(IV) ions.

16. A process as claimed in claim 6, wherein the phosphated metal surfaces are contacted with the acidic, silicate-containing aqueous solutions at temperatures of 20° to 25° C.

17. A process as claimed in claim 5, wherein the phosphated metal surfaces are contacted with the acidic, silicate-containing aqueous solutions at temperatures of 20° to 25° C.

18. A process as claimed in claim 4, wherein the phosphated metal surfaces are contacted with the acidic, silicate-containing aqueous solutions at temperatures of 20° to 25° C.

19. A process as claimed in claim 1, wherein the phosphated metal surfaces are contacted with the acidic, silicate-containing aqueous solutions at temperatures of 15° to 40° C.

20. A process as claimed in claim 1, wherein the phosphated metal surfaces are contacted with the acidic, silicate-containing aqueous solutions for 5 to 120 seconds.

* * * * *